United States Patent [19]

Mathiesen et al.

[11] Patent Number: 4,627,855

[45] Date of Patent: Dec. 9, 1986

[54] METHOD OF PREPARING AN AQUEOUS SLURRY OF SOLID CARBONACEOUS FUEL PARTICLES AND AN AQUEOUS SLURRY SO PREPARED

[75] Inventors: Mait M. Mathiesen, Summit, N.J.; Kent O. Svensson, Helsingborg, Sweden

[73] Assignees: AB Carbogel, Helsingborg; Berol Kemi AB, Stenunsund, both of Sweden; a part interest

[21] Appl. No.: 419,996

[22] Filed: Aug. 17, 1984

[30] Foreign Application Priority Data

Aug. 26, 1983 [GB] United Kingdom ..... 8323011

[51] Int. Cl.[4] ..... C10L 1/32

[52] U.S. Cl. ..... 44/51; 44/1 R; 252/309

[58] Field of Search ..... 44/51, 1 R; 252/309

[56] References Cited

U.S. PATENT DOCUMENTS

| | | | |
|---|---|---|---|
| 2,242,822 | 5/1941 | Fuchs | 44/51 |
| 3,632,479 | 1/1972 | Lee et al. | 201/32 |
| 3,960,513 | 6/1976 | Agaswal | 44/15 R |
| 3,993,456 | 11/1976 | Cole et al. | 44/51 |
| 4,066,664 | 9/1983 | Burgess et al. | 44/51 |
| 4,203,728 | 5/1980 | Norton | 44/51 |
| 4,261,701 | 4/1981 | Schulz et al. | 44/51 |
| 4,305,728 | 12/1981 | Schulz et al. | 44/51 |
| 4,332,593 | 6/1982 | Burgess et al. | 44/51 |
| 4,403,998 | 9/1983 | Schulz et al. | 44/51 |
| 4,406,664 | 9/1983 | Burgess et al. | 44/51 |
| 4,455,150 | 6/1984 | Olen | 44/51 |

FOREIGN PATENT DOCUMENTS

| | | |
|---|---|---|
| 0010289 | 4/1980 | European Pat. Off. . |
| 17729 | of 1915 | United Kingdom . |

OTHER PUBLICATIONS

Lowry, H. H., "Chemistry of Coal Utilization", Supplementary vol., (1963) pp. 272–289; John Wiley & Sons, New York, NY.

Igarashi, T., et al. "Effects of Weathering of Coals on Slurriabilities", Sixth International Coal Slurry Combustion and Technology, Jun. 25–27, 1984, Orlando, Florida, pp. 283–303.

*Primary Examiner*—William R. Dixon, Jr.
*Assistant Examiner*—Margaret B. Medley
*Attorney, Agent, or Firm*—Gordon W. Hueschen

[57] ABSTRACT

The surfaces of solid fuel particles, in a solid fuel particle slurry in water, are oxidized by exposure to the action of an oxidizing agent, representatively potassium permanganate, to alter the characteristics thereof and permit the employment of reduced amounts of surface-active agent for purposes of attaining desired characteristics of the slurry, which slurry also comprises a part of the invention as disclosed.

17 Claims, No Drawings

METHOD OF PREPARING AN AQUEOUS SLURRY OF SOLID CARBONACEOUS FUEL PARTICLES AND AN AQUEOUS SLURRY SO PREPARED

The predominantly hydrophobic nature of surfaces of particulate solid fuel such as coal, solid refinery by-products, and coke is often utilized in order to attach dispersant molecules to said surfaces which, when added in sufficient amounts, render the composition of solid fuel particles, water and dispersant pumpable.

A composition including approximately 20 to 35% w/w of water and 80 to 65% solid fuel particles with a maximum size ranging from 10 to 300 microns requires approximately 0.15 to 0.85% w/w of water-soluble surface active dispersant to attain sufficient flow. The dispersant concentration is in each case dependent on the available surface area of solid fuel particles, which varies with the surface structure and the particle size distribution.

It has now surprisingly been found that a conditioning of solid fuel particles in water with water-soluble oxidising agents such as, for example, potassium permanganate or hydrogen peroxide, brings about a change in the surface properties of the solid fuel so that the amounts of dispersant required for preparing a slurry of the solid fuel particles and water are significantly reduced. The selection of oxidant and suitable amounts thereof are readily established by one skilled in the art.

In other connections, it is previously known to oxidize coal and similar materials for other purposes. As examples of the prior art technique mention may be made of the following patent specifications:

U.S. Pat. No. 4,261,701 relates to an inexpensive dispersant for coal suspensions which consist of the reaction product of (1) polycyclic polycarboxylic acids, and (2) a base, such as sodium hydroxide. The polycyclic carboxylic acids are obtained by oxidation of coal. The coal which constitutes the solid fuel phase in the coal suspension is not oxidized according to the patent specification.

U.S. Pat. Nos. 4,305,728 and 4,403,998 correspond to U.S. Pat. No. 4,261,701, with the difference however that the dispersant is the coal proper in the coal suspension, i.e. the coal in the suspension is oxidized with oxygen or nitric acid for formation of polycyclic carboxylic acids and is then reacted with a base, such as sodium hydroxide.

U.S. Pat. No. 3,632,479 relates to the surface oxidation of coal at elevated temperature to prevent agglomeration.

U.S. Pat. No. 4,203,728 relates to the surface oxidation of coal in an oil-coal suspension.

DE No. 3,246,499 relates to the electrochemical conversion of coal by alternating anodic oxidation and cathodic reduction.

U.S. Pat. Nos. 4,332,593 and 4,406,664 relates to the hydrophobization of coal particles by means of a peroxide catalyzed polymerization process.

GB No. 17,729 of 1913 relates to the production of a colloidal solution or emulsion of coal by grinding. It is stated that the coal is decomposed into coal molecules and that this is realized by electrical friction forces or by means of tannin, formalin, potassium permanganate, chromic acid or the like.

The invention differs from the prior art in that the carbonaceous material is first subjected to a treatment with an oxidant, and that a dispersant is added to the thus conditioned material in conjunction with or directly after the oxidation treatment, the requisite amount of dispersant being drastically reduced by the oxidation treatment. In has been found that for a slurry which contains about 65–80% by weight of carbonaceous material and the rest water and additives such as dispersants, stabilizers, pH adjusting agents and the like, the amount of dispersants may very often be reduced to less than half the amount required to bring about the same stability and flowability properties of a corresponding slurry, but with carbonaceous material that has not been oxidation-treated. This implies that the amount of dispersant in the present invention generally can be reduced to be at most about 0.5% by weight based on the slurry weight, preferably at most about 0.3% by weight.

By the present invention there is provided a method of preparing an aqueous slurry of solid carbonaceous fuel particles by suspending the particles in water with the aid of a dispersion-producing amount of a water-soluble surface-active dispersant, wherein the surfaces of said solid carbonaceous fuel particles are conditioned by exposing them to the action of an oxidising agent, and the water-soluble surface-active dispersant is added to the thus conditioned fuel particles.

In the preferred embodiments of the method accordinging to the invention the surfaces of said fuel particles are exposed to a chemical oxidising agent other than air; the oxidising agent is water-soluble; the oxidising agent is selected from the group consisting of potassium permanganate, hydrogen peroxide, oxygen, ozone, chromic acid, hypochlorous acid, or an organic oxidising agent; the oxidising agent is potassium permanganate; the amount of oxidising agent employed is about one mole per mole of surface-active dispersant employed; the amount of oxidising agent is from about 0.0001 to 0.1% by weight based upon the weight of the solid fuel particles in the slurry; the amount of oxidising agent is from about 0.001% to about 0.03% by weight based upon the weight of the solid fuel particles in the slurry; the solid carbonaceous fuel particles are exposed to the oxidising agent in the form of a dilute suspension which is thereafter dewatered; the surface-active dispersant is admixed with the solid carbonaceous fuel particles subsequent to the oxidising step; the solid carbonaceous fuel particle surfaces are exposed to the action of the oxidising agent concurrently with the dispersant in a mixing step; finer solid carbonaceous fuel particles are treated separately with a different amount of oxidising agent than coarser solid carbonaceous fuel particles; and the finer particles have a maximum diameter of about 30 microns and the coarser particles have a maximum diameter of about 300 microns.

According to the invention there is also provided an aqeuous slurry of solid carbonaceous fuel particles, a dispersion-producing amount of a water-soluble surfaceactive dispersant and water, wherein the solid carbonaceous fuel particles have partially oxidised surfaces.

In the preferred embodiments of the aqueous slurry according to the invention the partially oxidised surfaces of the fuel particles have been oxidised by exposure to a chemical oxidising agent other than air; the partically oxidising surfaces of the fuel particles have been oxidised by exposure to potassium permanganate;

the slurry is a mixture of finer solid fuel particles and coarser solid fuel particles, each of which groups of particles has been separately treated with oxidising agent for oxidation of the surfaces thereof and thereafter combined; the finer particles have a maximum diameter of about 30 microns and the coarser particles have a maximum diameter of about 300 microns; the slurry comprises about 65–80% by weight of solid carbonaceous fuel particles, the rest being water and additives including not more than about 0.5% by weight by water-soluble surface-active dispersant; and the amount of dispersant is not more than about 0.3% by weight.

Further details and features of the invention will appear from the following specification and the appended claims.

In general, the invention is perferably carried out in either of the following ways:

1. The solid fuel particles are suspended in water by means of mechanical agitation, prior to dewatering to the final desired moisture content. At this stage of the slurry manufacturing process, the selected amount of oxidant—in the case of $KMnO_4$ about 0.001% to 0.03% by weight on solid fuel weight—is added to the dilute suspension. Retention time is less critical inasmuch as the surface oxidation proceeds rapidly to the desired level as determined by the selection of the amount of oxidant employed.

After conditioning, the dilute suspension is dewatered by conventional means to a moisture content of about 15 to 35% by weight. The dewatered product is then admixed with the selected dispersant; the amounts of dispersant now being reduced by the partial oxidation, and a pumpable slurry product is produced.

After production of the pumpable slurry, a further quantity of oxidant—about 50% or less of the original quantity employed—may be added to the slurry to ensure that an excess of oxidant is present to maintain a proper balance between oxidised portions of the particle surfaces and the reduced amount of dispersant used.

2. Particularly if the solid fuel particles display limited porosity, and therefore limited effective surface area, the oxidant may be added simultaneously with the dispersing agent in the final mixing process. The rate of oxidation is far higher than the rate of dispersant absorption, as shown in experiments.

3. In cases where the solid fuel particles are porous, and therefore consume extreme quantities of dispersing agent if not pretreated with oxidant, it is preferred to employ a different procedure:

The oxidant used in the conditioning stage prior to dewatering is employed in larger quantity (over 0.01% by weight of solid fuel weight) in order to ensure effective oxidation of the entire particle surface including pore surfaces.

The solid fuel is thus well oxidised and displays little affinity to surface active dispersing agents in that state or at that stage. When mixing the slurry after dewatering, the moist particles (at about 15–35% moisture content) are mechanically agitated prior to dispersant addition, whereby the outer surfaces of the particles by means of shear and attrition become increasingly hydrophobic, and thus effective anchoring sites for dispersants. The mechanical agitation is carried out to the extent that is required as determined by testing the amount of dispersant required to achieve a pumpable slurry, a procedure easily executed by one skilled in the art.

4. In cases where the solid fuel particles display a size distribution with relatively high amounts of very fine particles, which represent the majority of the available particle surface area, it is preferred to treat the finer fractions separately with a different, perferably higher, amount of oxidant than the coarser particles. Normally, it is preferred to treat the particles of a maximum size of about 5 to 30 micron diameter differently than those reaching a maximum of about 50 to 300 micron diameter. It is also important to note the following:

In order to reduce the impurities content (i.e., mineral matter including inorganic sulphur-containing species), the solid fuel may have to be divided into extremely fine size, down to about minus 20 micron size (i.e., maximum size of 20 microns) or less. This makes possible the liberation of very fine inorganic species in the fuel. A slurry of this size distribution, however, requires high dispersant levels owing to the very large surface area of the particles, and preoxidation will reduce this dispersant requirement considerably, while producing a slurry of sufficiently favourable rheological properties without incurring prohibitive dispersant cost.

EXAMPLE 1

A 200 g sample of coal particles (Terry Eagle coal ex Hanna Mining Company, Virginia) of 160 micron top size was slurried with water and an ethoxylated dinonylphenol dispersant (degree of ethoxylation=70) and required 0.55% by weight of dispersant on slurry weight to reach sufficient fluidity at 73% coal content; i.e. a viscosity of less than 1000 CPS at 30 $s^{-1}$ shear rate.

An identical coal sample was then conditioned with 0.008% of $KMnO_4$ (w/coal w) dissolved in the slurry water while adding dispersant to the mixture. This slurry reached sufficient fluidity at 0.22% of dispersant on slurry weight.

EXAMPLES 2–8

The following oxidising agents are employed in the procedure of Example 1 with equal facility and with equal success: Hydrogen peroxide, oxygen, ozone, and hypochlorous acid, as well as the organic peroxides benzoyl peroxide and tertiary-butyl hypochlorite. Others may also be used if desired, e.g., chromic acid.

Based upon the weight of the solid fuel particles involved in the slurry, the operative ranges for the various oxidising agents employed according to the present invention are as follows:

Potassium permanganate—0.001% to about 0.03%
Hydrogen peroxide—0.0003% to about 0.01%
Oxygen—0.0001% to about 0.005%
Ozone—0.0005% to about 0.02%
Hypochlorous acid—0.0005% to about 0.02%
Benzoyl peroxide—0.0006% to about 0.04%
Tertiary-butyl hypochlorite—0.0006% to about 0.04%

When oxygen is used as the oxidising agent according to the invention, it is according to the usual procedure dissolved and reacted in the presence of a catalyst, such as copper or manganese vanadate. The general range of oxidant, which in all cases should be water-soluble, is on the order of 0.0001% to about 0.1%, based on the solid fuel particle weight, and an excess over such amounts is generally recommended in order completely to oxidise pore surfaces or at least more completely oxidise the same.

The invention is valuable in that it significantly reduces the cost of preparing a slurry, in addition to which the viscosity of the slurry is reduced as compared to a slurry which reaches fluidity at a higher dispersant concentration, i.e., a slurry in which the coal or solid fuel particles have not been treated with oxidant.

Although the applicants do not wish to be limited by any theory of operation, it is believed that exposure of the surfaces of the individual solid fuel particles to the oxidising agent reduces the number of hydrophobic sites for attachment thereto of the hydrophobic end of the dispersing surface-active agent, thereby reducing the number of sites to which the hydrophobic end of the dispersing surface-active agent can attach itself on an individual particle surface and, moreover, it is believed that the oxidation of the surface of the individual solid fuel particles also introduces, to a certain extent at least, additional hydrophilic sites directly on the solid fuel particle surface itself. This would at least offer a partial explanation for the fact that pumpable, flowable, and stable slurries are attained, with the employment of this oxidation step, which require lesser amounts of dispersing surface-active agent for purposes of attaining the same desirable characteristics of dispersability, pumpability, and stability in the ultimate slurry, than the same composition without the oxidation feature.

The amount of the oxidant to be used is generally determined by the properties of the coal surface. It is generally useful to balance the amount of oxidant and the amount of dispersant in such a way that one mole of oxidant, e.g. $KMnO_4$, is considered equivalent to one mole of dispersant used. Thus, the amount of dispersant rendered superfluous can be eliminated and/or any excess controlled.

What we claim and desire to secure by Letters Patent is:

1. A method of preparing an aqueous slurry of about 65 to about 80% by weight of solid carbonaceous fuel particles consisting essentially of the following steps:

(a) conditioning the surfaces of said solid carbonaceous fuel particles by exposing them to the action of a reagent consisting essentially of at least about 0.0001% by weight, based upon the weight of the solid fuel particles, of a water-soluble chemical oxidising agent other than air to oxidise said surfaces and make the more hydrophilic and (b) suspending the thus-conditioned carbonaceous fuel particles in water with the aid of a dispersion-producing amount of a water-soluble surface-active dispersant, provided, however, that when the oxidising agent is oxygen, it is used in the presence of a catalyst.

2. A method as claimed in claim 1, wherein the oxidising agent is selected from the group consisting of potassium permanganate, hydrogen peroxide, oxygen plus a catalyst, ozone, chromic acid, hypochlorous acid, or an organic oxidising agent.

3. A method as claimed in claim 1, wherein the oxidising agent is potassium permanganate.

4. A method as claimed in claim 1, wherein the amount of oxidising agent employed is about one mole per mole of surface-active dispersant employed.

5. A method as claimed in claim 1, wherein the amount of oxidising agent is from about 0.0001 to 0.1% by weight based upon the weight if the solid fuel particles in the slurry.

6. A method as claimed in claim 5, wherein the amount of oxidising agent is from about 0.001% to about 0.03% by weight based upon the weight of the solid fuel particles in the slurry.

7. A method as claimed in claim 1, wherein the solid carbonaceous fuel particles are exposed to the oxidising agent in the form of a dilute suspension which is thereafter dewatered.

8. A method as claimed in claim 1, wherein the surface-active dispersant is admixed with the solid carbonaceous fuel particles subsequent to the oxidising step.

9. A method as claimed in claim 1, wherein the solid carbonaceous fuel particle surfaces are exposed to the action of the oxidising agent concurrently with the dispersant in a mixing step.

10. A method as claimed in claim 1, wherein finer solid carbonaceous fuel particles are treated separately with a different amount of oxidising agent than coarser solid carbonaceous fuel particles.

11. A method as claimed in claim 10, wherein the finer particles have a maximum diameter of about 30 microns and the coarser particles have a maximum diameter of about 300 microns.

12. An aqueous slurry consisting essentially of (a) about 65 to about 80% by weight of solid carbonaceous fuel particles, which have been conditioned to partially oxidise the surfaces thereof and make them more hydrophilic by exposing said particles to at least about 0.0001% by weight, based upon the weight of the solid fuel particles, of a water-soluble chemical oxidising agent other than air, (b) a dispersion-producing amount of a water-soluble surface-active dispersant, and (c) water, provided, however, that when the oxidizing agent is oxygen, it is used in the presence of a catalyst.

13. An aqueous slurry as claimed in claim 12, wherein the partially oxidised surfaces of the fuel particles have been oxidised by exposure to potassium permanganate.

14. An aqueous slurry as claimed in claim 12, wherein the slurry is a mixture of finer solid fuel particles and coarser solid fuel particles, each of which groups of particles has been separately treated with oxidising agent for oxidation of the surfaces thereof and thereafter combined.

15. An aqueous slurry as claimed in claim 14, wherein the finer particles have a maximum diameter of about 30 microns and the coarser particles have a maximum diameter of about 300 microns.

16. An aqueous slurry as claimed in claim 12, wherein slurry includes not more than about 0.5% by weight of water-soluble surface-active dispersant.

17. An aqueous slurry as claimed in claim 16, wherein the amount of dispersant is not more than about 0.3% by weight.

* * * * *